US005735431A

United States Patent [19]

LeTrudet

[11] Patent Number: 5,735,431

[45] Date of Patent: Apr. 7, 1998

[54] BIN HAVING AN ARCHED BEAM BOTTOM

[75] Inventor: Stephane F. LeTrudet, St. Charles, Mo.

[73] Assignee: Allibert-Contico, L.L.C., St. Louis, Mo.

[21] Appl. No.: 699,620

[22] Filed: Aug. 19, 1996

[51] Int. Cl.[6] ..... B65D 6/00

[52] U.S. Cl. ..... 220/639; 220/1.5; 220/636

[58] Field of Search ..... 220/639, 636, 220/608, 607, 1.5, 635

[56] References Cited

U.S. PATENT DOCUMENTS

| | | | |
|---|---|---|---|
| D. 242,660 | 12/1976 | Astle . | |
| 689,093 | 12/1901 | Kestenbaum . | |
| 2,464,343 | 3/1949 | Praeger et al. . | |
| 3,366,273 | 1/1968 | Crocella et al. . | |
| 4,000,827 | 1/1977 | Emery | 220/1.5 X |
| 4,674,647 | 6/1987 | Gyenge et al. | 220/1.5 X |
| 4,936,615 | 6/1990 | Moore | 220/1.5 X |
| 5,244,108 | 9/1993 | Hale . | |
| 5,332,115 | 7/1994 | Schafer | 220/636 X |
| 5,392,945 | 2/1995 | Syrek . | |
| 5,397,022 | 3/1995 | Schäfer . | |

*Primary Examiner*—Steven M. Pollard

*Attorney, Agent, or Firm*—Howell & Haferkamp, L.C.

[57] ABSTRACT

A bin comprises a bin bottom, forward and rearward opposing end walls, and first and second opposing side walls. The end walls and side walls extend up from the bottom and define a bin interior configured for holding product. The bottom comprises a support beam extending generally rearwardly from the forward end wall to the rearward end wall. The support beam is laterally spaced between the side walls. A plurality of stiffening ribs are between the support beam and side walls, and have generally straight lower edges. The support beam is generally arch shaped.

20 Claims, 9 Drawing Sheets

BIN HAVING AN ARCHED BEAM BOTTOM

BACKGROUND OF THE INVENTION

This invention relates to storage bins and more particularly to bins for storage and shipment of fruit, such as citrus fruit.

Conventional fruit bins are open top bins having a bottom and four side walls defining a product receiving interior. They are generally of wood construction and of a size for holding a relatively large quantity (e.g., twenty bushels) of product. These bins generally have flat undersides or central reinforcing beams with flat undersides. These bins are also configured to be stacked one upon another.

A disadvantage of such prior art bins is that care must be taken to ensure that they are not filled to a point of heaping, i.e., of having product above the upper edges of the bin. If a bin is over-filled in this manner, then the stacking of another bin thereon will squash and thereby damage the product. The product in the lower bin may also prevent the upper bin from properly resting on the lower bin, thereby resulting in an unstable stacking arrangement.

Another disadvantage of such prior art bins is that the bottoms tend to bow or buckle under the weight (possibly in excess of 1000 lbs) of the product. Such reinforcement adds to the weight of the bin and increases its cost of manufacture. This bowing in an upper bin may tend to crush fruit or product in a lower bin or cause damage to the bin itself.

SUMMARY OF THE INVENTION

Among the several objects of the present invention may be noted the provision of an improved bin for storage and shipment of fruits, vegetables, etc.; the provision of such a bin which is configured to be stacked upon another like bin; the provision of such a bin which is shaped and configured to avoid squashing product when stacked on a like bin heaped with product; the provision of such a bin configured to resist bowing or buckling when filled with product; the provision of such a bin which is economical to manufacture; and the provision of such a bin which is of relatively simple construction.

In general, a bin of the present invention comprises a bin bottom, forward and rearward opposing end walls, and first and second opposing side walls. The end walls and side walls extend up from the bottom and define a bin interior configured for holding product. The bottom comprises a support beam extending generally rearwardly from the forward end wall to the rearward end wall. The support beam is laterally spaced between the side walls. A plurality of stiffening ribs are between the support beam and side walls, and have generally straight lower edges. The support beam is generally arch shaped.

In another aspect of the present invention, a bin comprises a bin bottom, and a plurality of walls extending up from the bottom and defining a bin interior configured for holding product. The bottom comprises a plurality of stiffening ribs and at least one arch-shaped support beam. The support beam has a downwardly-facing, arcuate surface. At least part of the arcuate surface is below the stiffening ribs.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
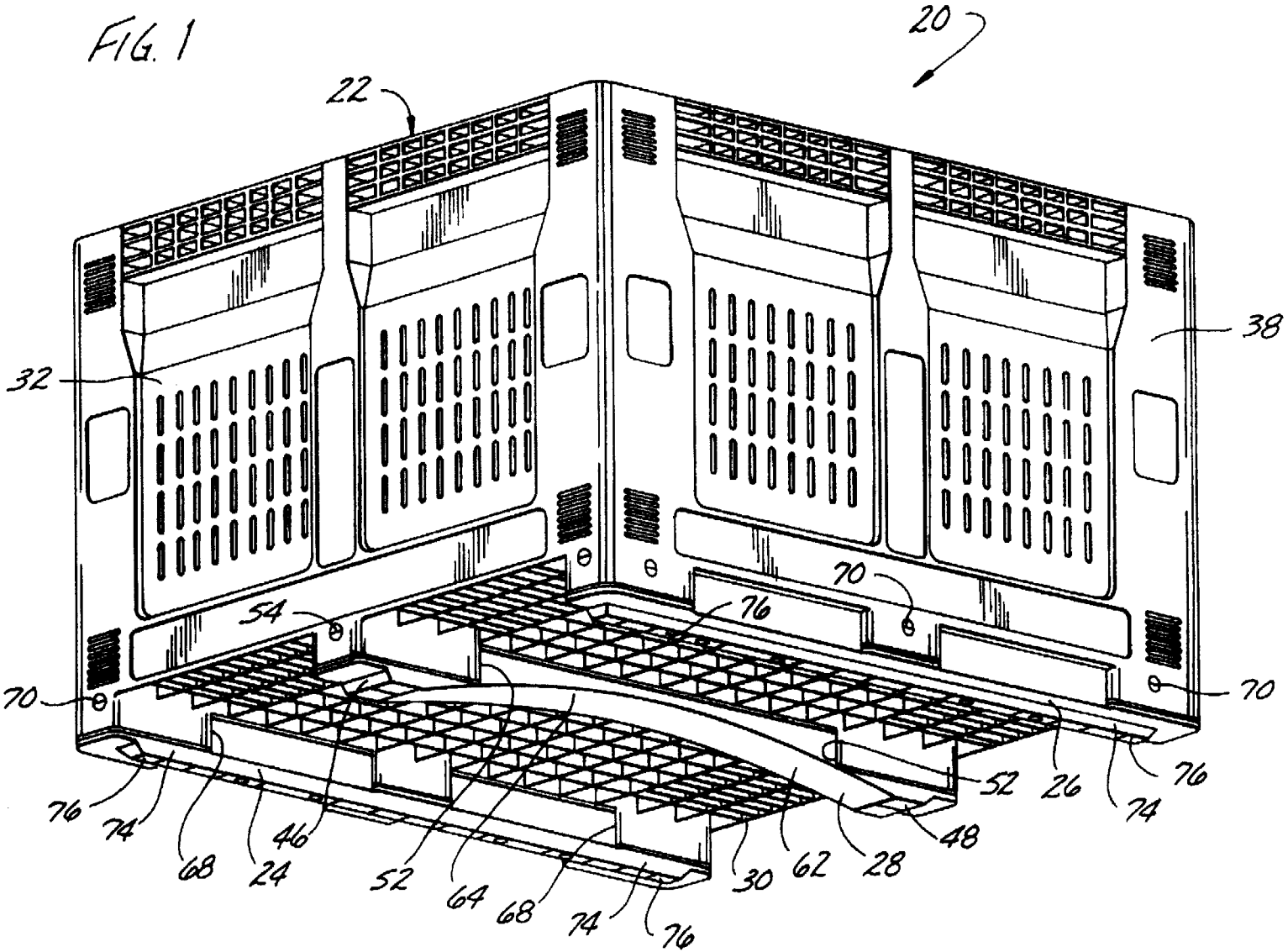
FIG. 1 is a perspective view of a bin of the present invention having a box member, left and right side support beams, and an arch-shaped intermediate (center) support beam, the support beams being secured to the underside of the box member.
Figure 2:
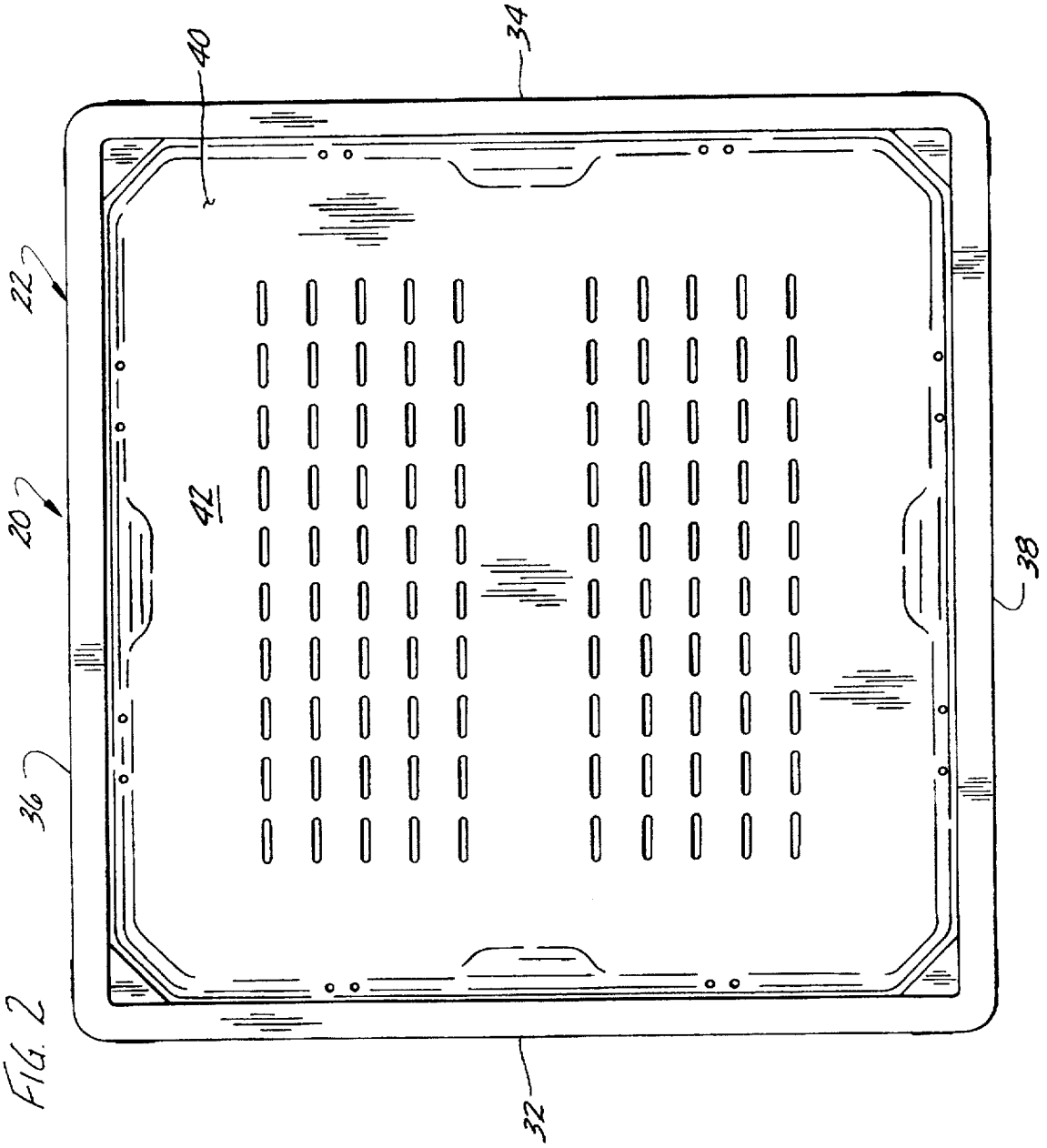
FIG. 2 is a top plan view of the bin of FIG. 1.
Figure 3:
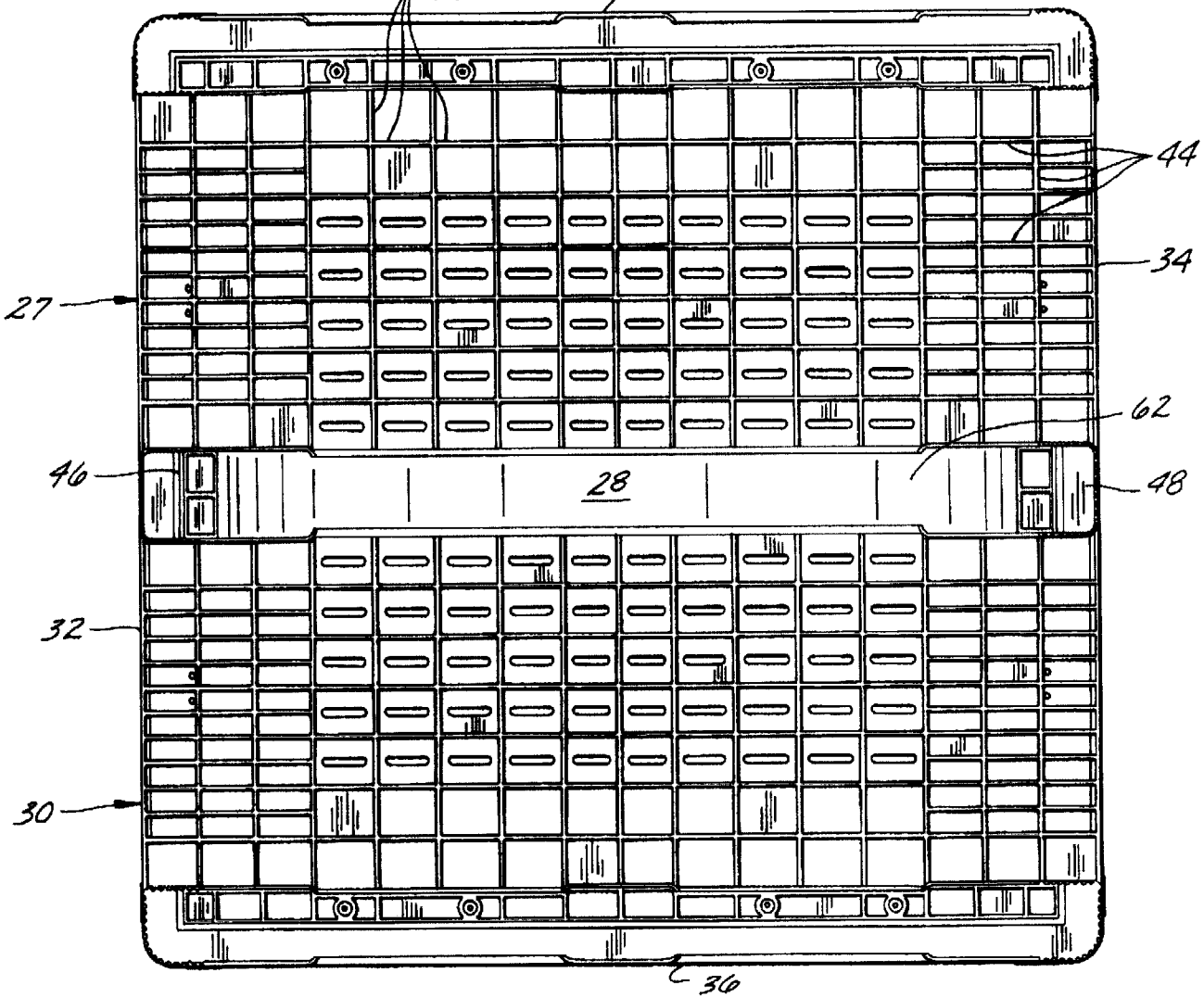
FIG. 3 is a bottom plan view of the bin of FIG. 1.
Figure 4:
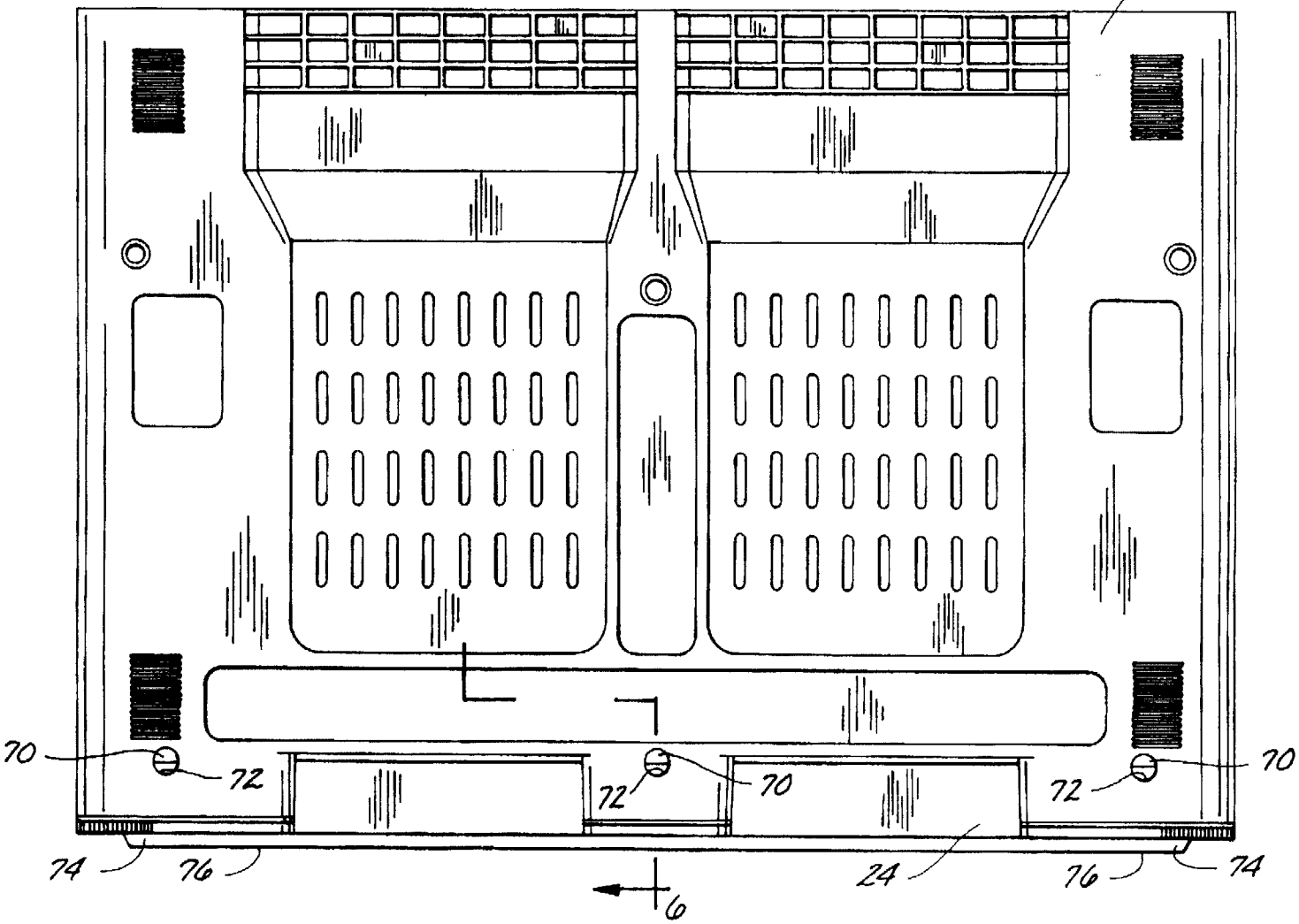
FIG. 4 is a side elevational view of the bin of FIG. 1.
Figure 5:
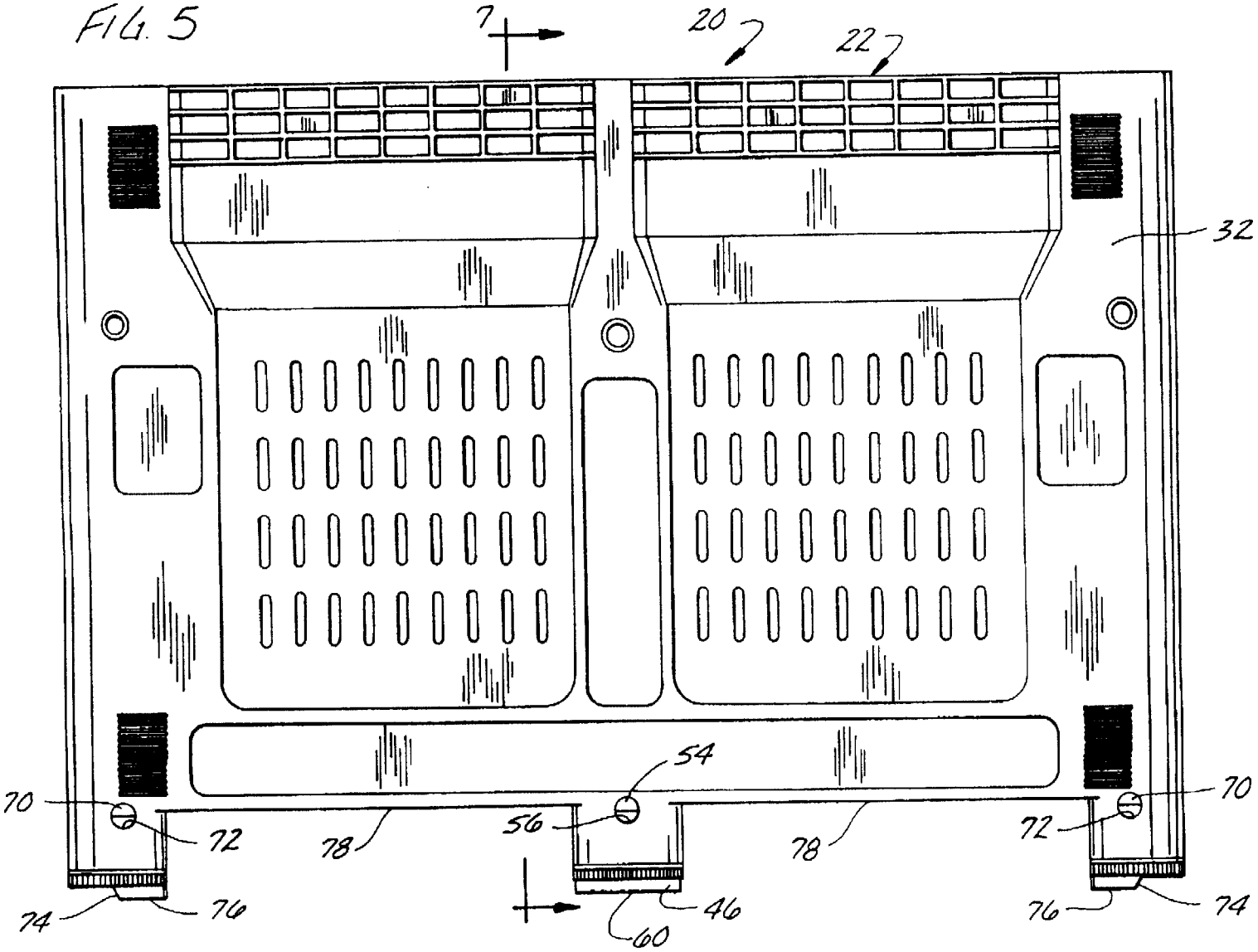
FIG. 5 is a front end elevational view of the bin of FIG. 1.

Referring now to the drawings, and first more particularly to FIGS. 1–5, a bin is indicated in its entirety by the reference numeral 20. The bin 20 has a box member 22, left and right side support beams 24, 26, and an intermediate support beam 28. The support beams 24, 26, 28 are secured to the underside of the box member 22.

The box member 22 is preferably of a one piece (i.e., monolithic) high density polyethylene (HDPE) construction, but could alternatively be of a multiple piece construction and could have collapsible side walls. Preferably, the box member 22 is formed by injection molding. However, it is to be understood that the box member 22 may be formed by other means, such as vacuum form, structural foam, blow molding, etc., without departing from the scope of this invention. The box member 22 includes a box bottom 30, forward and rearward opposing end walls 32, 34, and left (first) and right (second) opposing side walls 36, 38. Preferably, the end and side walls 32, 34, 36, 38 extend generally vertically up from the box bottom 30. The walls and box bottom define a bin interior 40 configured for holding product such as citrus fruit or other agricultural or non-agricultural products. The upper ends of the walls define a bin opening for introduction of product into and removal of product from the bin interior 40.

Figure 6:
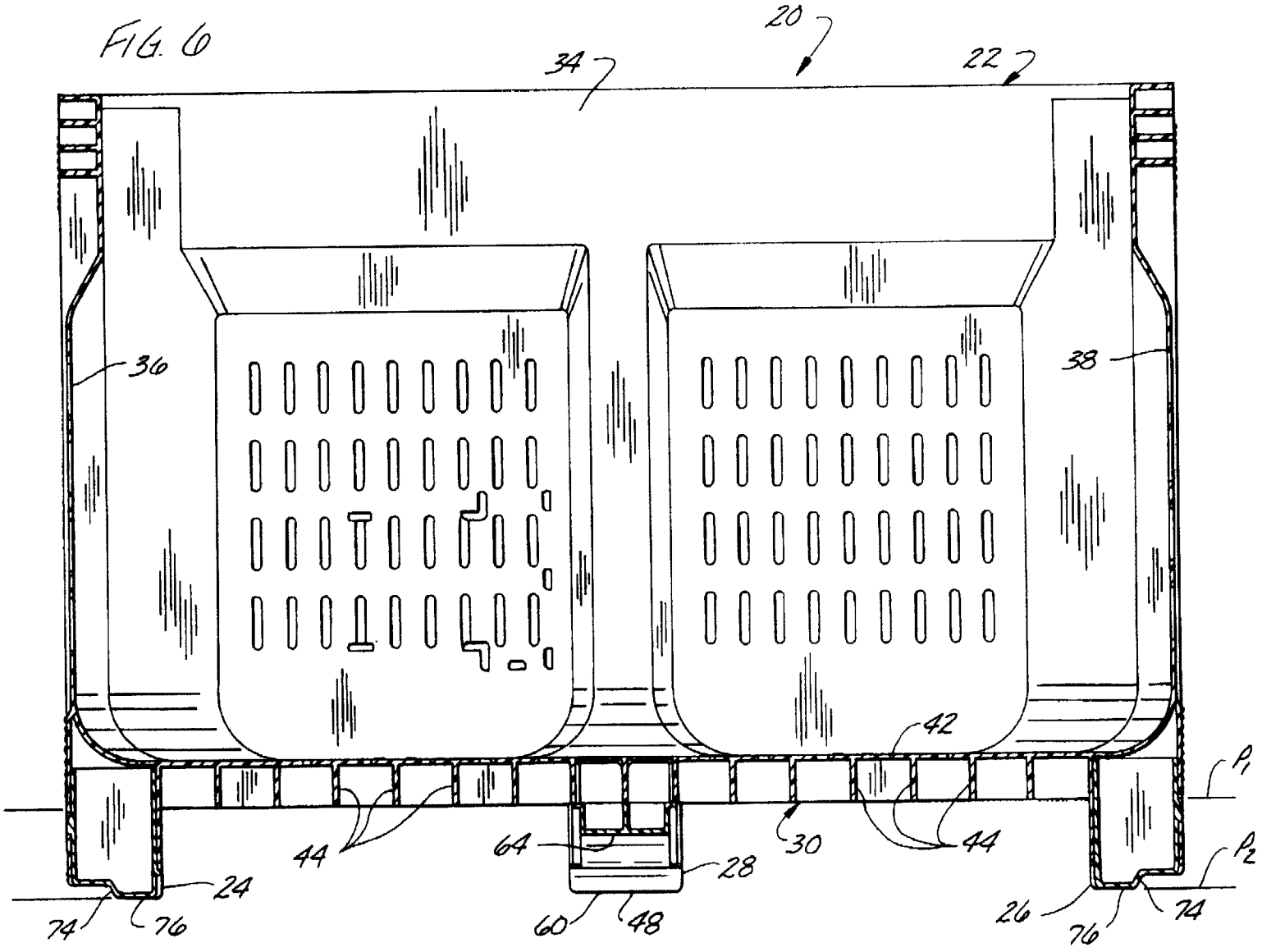
FIG. 6 is a cross-sectional view taken along the plane of line 6—6 of FIG. 4.
Figure 7:
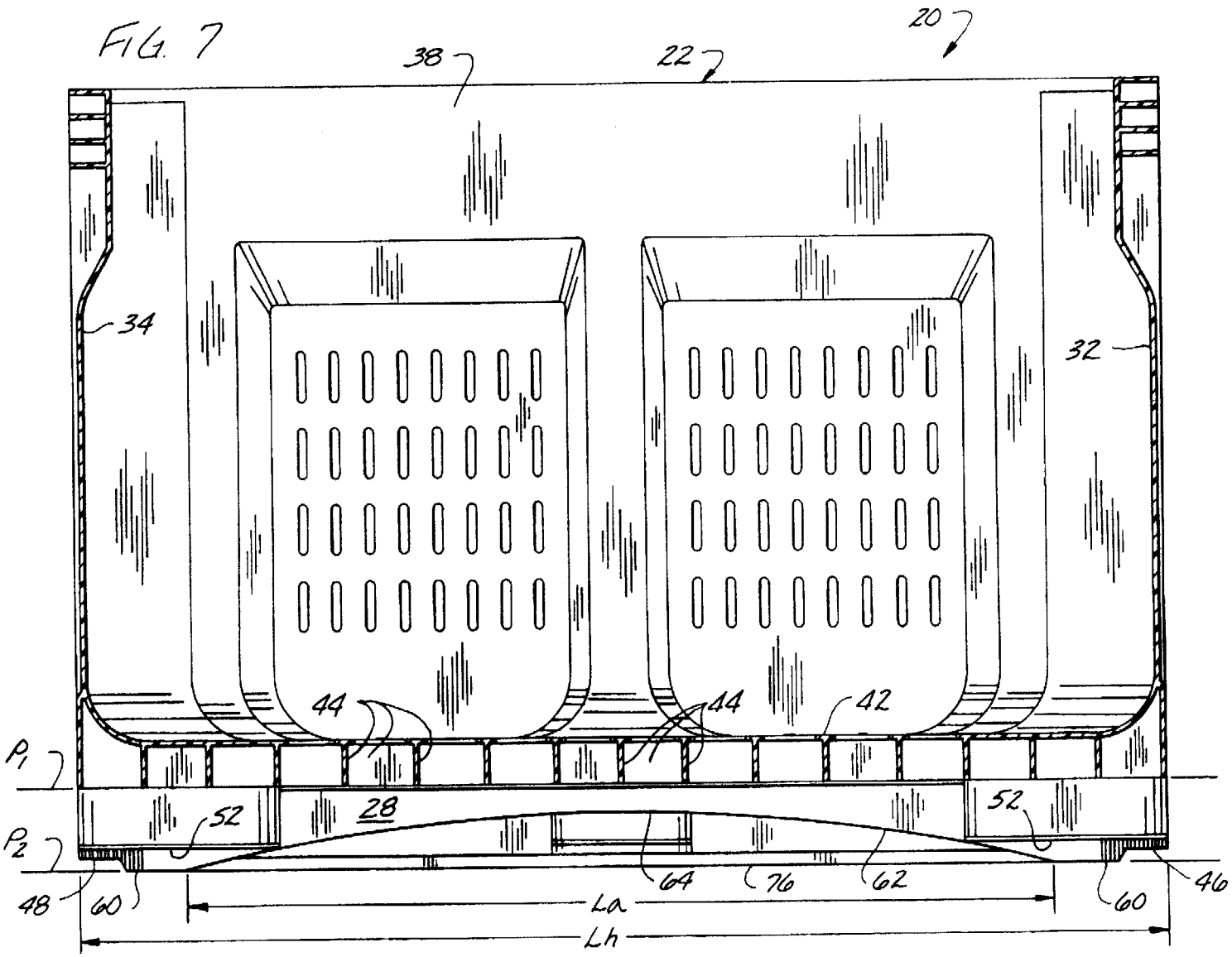
FIG. 7 is a cross-sectional view taken along the plane of line 7—7 of FIG. 5.
Figure 8:
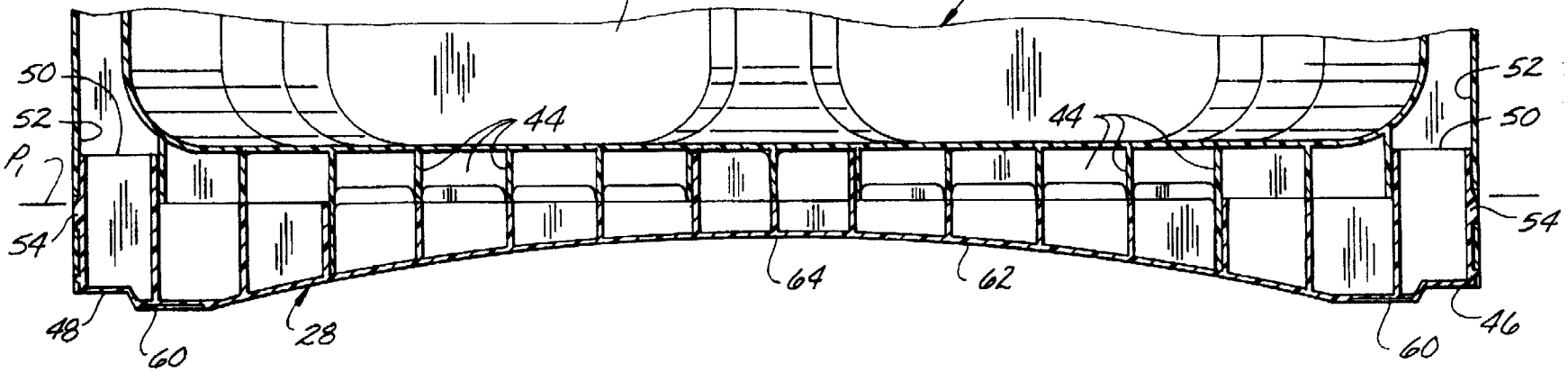
FIG. 8 is an enlarged, fragmented, longitudinal cross-sectional view showing the arch-shaped center support beam connected to the box member.

The box bottom 30 comprises a generally planar floor 42 and a plurality of stiffening ribs 44 depending from and stiffening the box bottom's floor. Preferably, some of the stiffening ribs 44 extend generally from one end of the bin to the other (i.e., from left to right as viewed in FIG. 3) and others extend generally from one side of the bin to the other (i.e., from top to bottom as viewed in FIG. 3). Thus, the stiffening ribs 44 are preferably in a grid-like configuration. Preferably, the stiffening ribs 44 have generally straight lower edges. The lower edges are preferably generally coplanar and lie in a plane $P_1$ (FIGS. 6–8). As discussed in greater detail below, the box bottom 30 further includes downwardly opening sockets in its underside for connection of the support beams 24, 26, 28 to the box bottom. The box bottom 30 and the support beams 24, 26, 28 constitute a bin bottom.

The intermediate support beam 28 is generally arch shaped and is attached to the underside of the box member 22. It extends generally rearwardly from the forward end wall 32 to the rearward end wall 34 and is laterally spaced between the side walls 36, 38. Preferably, the intermediate support beam 28 is parallel to and spaced equidistant between the side walls 36, 38. It has a forward end portion 46 generally under the forward end wall 32, a rearward end portion 48 generally under the rearward end wall 34, and plugs 50 extending upward from the forward and rearward end portions which snugly fit into intermediate sockets 52 formed in the underside of the box bottom 30. The plugs 50 have locking tabs 54 (FIGS. 5 and 8) extending laterally therefrom. The locking tabs 54 are configured for a snap fit engagement in tab receiving openings 56 of the intermediate sockets 52 for locking the intermediate support beam 28 to the box member 22.

The forward and rearward end portions 46, 48 of the intermediate support beam 28 act as feet and have downwardly facing surface portions 60 engageable with the ground or with the upper edges of the walls of another bin when the bin 20 is stacked atop such another bin. The downwardly facing surface portions 60 of the end portions 46, 48 lie in a plane $P_2$ (FIGS. 6 and 7) spaced approximately three to four inches below the plane $P_1$.

The underside of the intermediate support beam 28 has a downwardly-facing, arcuate surface 62 between the surface portions 60 of the end portions 46, 48. Preferably, the arcuate surface 62 of the intermediate support beam 28 is entirely below the lower edges of the stiffening ribs 44, i.e., is entirely below the plane $P_1$. The arcuate surface 62 of the intermediate support beam 28 defines an arc having a length $L_a$ (FIG. 7) which is preferably greater than half the bin's length (i.e., the distance $L_b$ between the forward and rearward end walls 32, 34) and more preferably is greater than three-fourths the bin's length. As shown in FIGS. 7 and 8, the arc of the arcuate surface 62 has an apex 64 generally equidistant between the forward and rearward end walls 32, 34.

Figure 9:
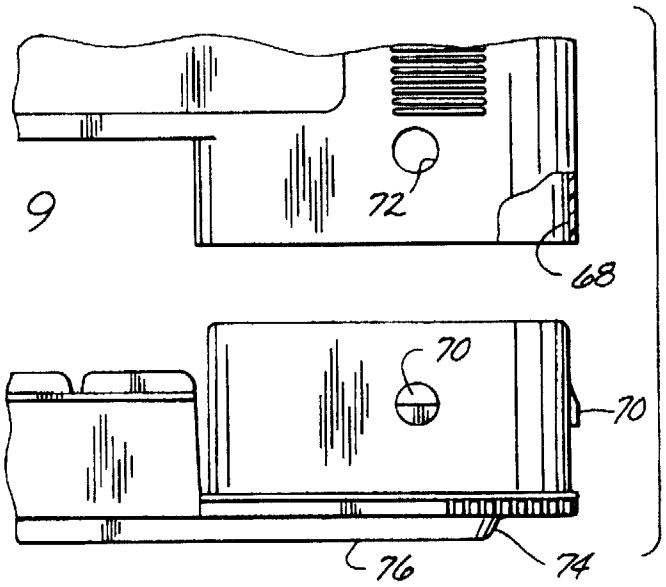
FIG. 9 is an enlarged, fragmented, exploded view of a side support beam and the box member of FIG. 1 with portions broken away to show detail.

The left and right side support beams 24, 26 are attached to the underside of the box member 22 under the left and right side walls 36, 38, respectively. The side support beams 24, 26 extend generally rearwardly from the forward end wall 32 to the rearward end wall 34 and are generally parallel with the intermediate support beam 28. The side support beams 24, 26 include upwardly extending plugs 66 configured for a snug fit into sockets 68 formed in the underside of the box bottom 30. The plugs 50 have locking tabs 70 (FIGS. 5 and 9) extending laterally therefrom. The locking tabs 70 are configured for a snap fit engagement in tab receiving openings 72 of the sockets 68 for locking the side support beams 24, 26 to the box member 22. The side support beams 24, 26 further include foot portions 74 at least at opposite ends thereof. Each foot portion 74 includes a downwardly facing side surface portion 76 engageable with the ground or with the upper edges of the walls of another bin when the bin 20 is stacked atop such another bin. The downwardly facing side surface portions 76 lie in the plane $P_2$ and generally under the side walls. They are engageable with the ground or with the upper edges of the walls of another bin when the bin 20 is stacked atop such another bin.

The support beams 24, 26, 28 space the floor 42 of the box bottom 30 above the surface upon which the bin 20 is placed and define tine receiving channels for receiving the tines (not shown) of a fork lift truck. The bin 20 is of sufficient size for holding in excess of 1000 lbs of product. The intermediate support beam 28 reinforces the box bottom 30 to resist bowing or buckling of the box bottom under the weight of the product.

Figure 10:
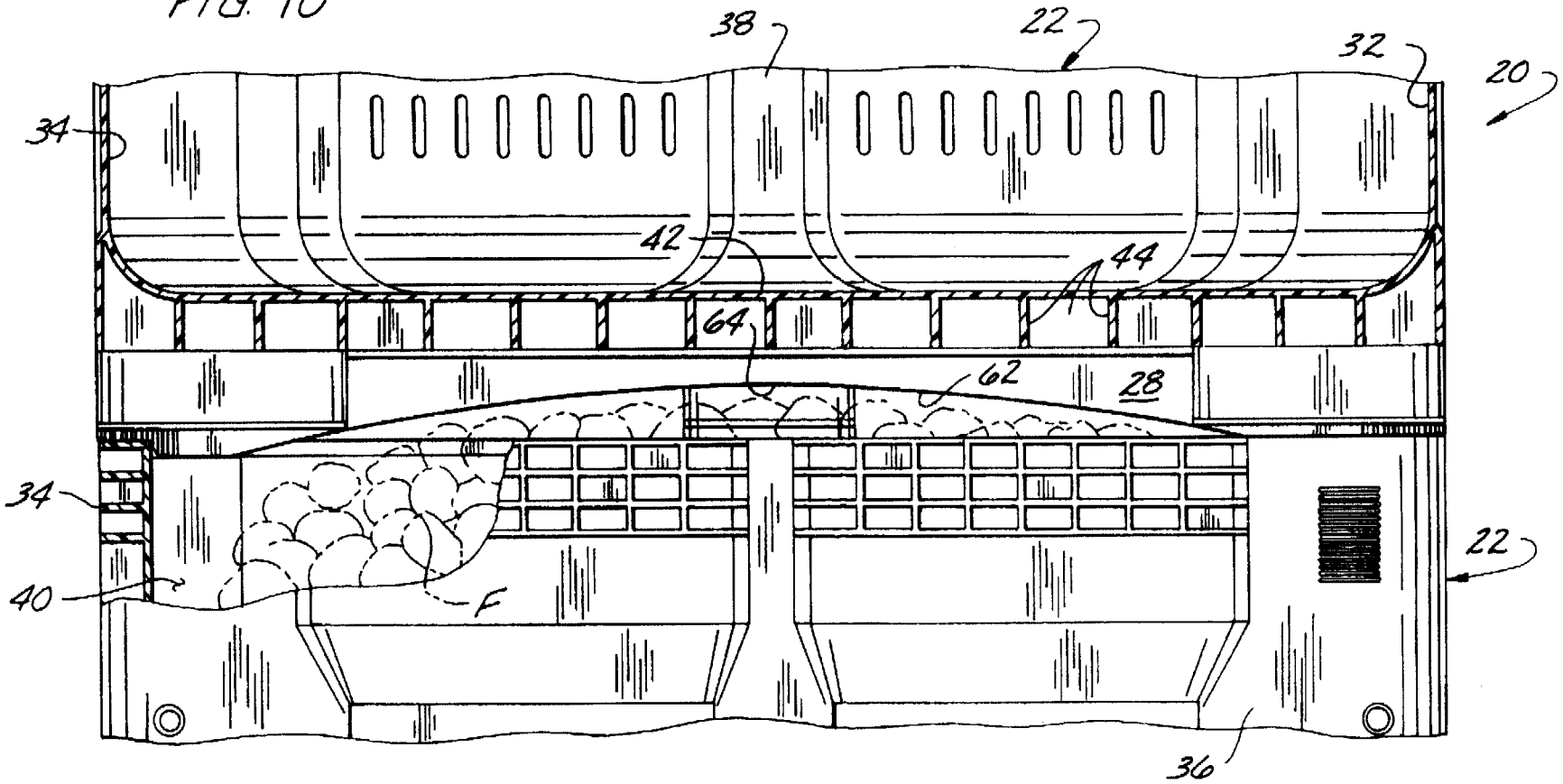
FIG. 10 is an enlarged, fragmented, side elevational view of two identical bins of FIG. 1 with portions broken away to show detail, one of the bins being stacked atop the other bin.

FIG. 10 shows two identical bins 20 of the present invention stacked one atop the other and holding fruit F. The arch shape of the intermediate support beam 28 allows the upper bin to be stacked on the lower bin without the upper bin crushing the product of the lower bin, even if the product is heaped above the top of the lower bin as shown in FIG. 10. The intermediate support beam 28 also prevents bowing of the box bottom 30 and thereby allows the bin to hold fruit in excess of 1000 lbs.

Although the bin 20 has been described as having the support beams 24, 26, 28 separate from the box member 22, it is to be understood that the support beams and box member could be integrally formed together so that the bin is a single monolithic piece without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bin comprising:

a bin bottom; and forward and rearward opposing end walls and first and second opposing side walls, said end walls and side walls extending up from the bottom and defining a bin interior configured for holding product;

said bottom comprising a support beam extending generally rearwardly from the forward end wall to the rearward end wall and being laterally spaced between the side walls, and a plurality of stiffening ribs between the support beam and side walls, said stiffening ribs having generally straight lower edges, said support beam being generally arch shaped and having a downward-facing, arcuate surface constituting a part of an underside of the bottom, said arcuate surface being generally curved as viewed in a vertical cross-section taken along the length of the support beam.

2. A bin as set forth in claim 2 wherein the arcuate surface of the support beam is entirely below the lower edges of the stiffening ribs.

3. A bin as set forth in claim 1 wherein the lower edges of the stiffening ribs are generally coplanar and generally lie in a plane $P_1$.

4. A bin as set forth in claim 3 wherein at least part of the arcuate surface of the support beam is below the plane $P_1$.

5. A bin as set forth in claim 4 wherein the support beam has a forward end portion generally under the forward end wall and a rearward end portion generally under the rearward end wall, said end portions having downwardly facing surface portions lying in a plane $P_2$ spaced below the plane $P_1$.

6. A bin as set forth in claim 5 further comprising downwardly facing side surface portions lying in the plane $P_2$ and being generally under the side walls.

7. A bin as set forth in claim 3 wherein the arcuate surface of the support beam is entirely below the plane $P_1$.

8. A bin as set forth in claim 1 wherein the support beam is generally equidistant between the first and second side walls.

9. A bin as set forth in claim 1 wherein said bin has a length defined by the distance between the end walls, said arcuate surface of the support beam defining an arc having a length which is greater than half the length of the bin.

10. A bin as set forth in claim 1 wherein the walls have upper ends defining a bin opening.

11. A bin comprising:

a bin bottom; and a plurality of walls extending up from the bottom and defining a bin interior configured for holding product;

said bottom comprising a plurality of stiffening ribs and at least one arch-shaped support beam, said support beam having a downwardly-facing, arcuate surface constituting a part of an underside of the bottom, at least part of the arcuate surface being below the stiffening ribs, said arcuate surface being generally curved as viewed in a vertical cross-section taken along the length of the support beam.

12. A bin as set forth in claim 11 wherein the stiffening ribs have generally straight lower edges, said lower edges being generally coplanar and generally lying in a plane $P_1$, at least part of the arcuate surface of the support beam being below the plane $P_1$.

13. A bin as set forth in claim 12 wherein the arcuate surface of the support beam is entirely below the plane $P_1$.

14. A bin as set forth in claim 11 wherein the stiffening ribs are in a grid-like configuration.

15. A bin as set forth in claim 11 wherein the plurality of walls comprise forward and rearward opposing end walls and first and second opposing side walls, said end walls and side walls extending up from the bottom and defining the bin interior, the support beam extending generally rearwardly from the forward end wall to the rearward end wall and being laterally spaced between the side walls.

16. A bin as set forth in claim 15 wherein said bin has a length defined by the distance between the end walls, said arcuate surface of the support beam defining an arc having a length which is greater than half the length of the bin.

17. A bin as set forth in claim 11 wherein the bottom of the bin further comprises a generally planar floor supported by the stiffening ribs and support beam.

18. A bin comprising:

a bin bottom; and a plurality of walls extending up from the bottom and defining a bin interior configured for holding product, the plurality of walls comprising forward and rearward opposing end walls and first and second opposing side walls, said end walls and side walls extending up from the bottom and defining the bin interior;

said bottom comprising a plurality of stiffening ribs and at least one arch-shaped support beam, said support beam having a downwardly-facing, arcuate surface, at least part of the arcuate surface being below the stiffening ribs, the support beam extending generally rearwardly from the forward end wall to the rearward end wall and being laterally spaced between the side walls, said arcuate surface being generally curved as viewed in a vertical cross-section taken along the length of the support beam;

said bin having a length defined by the distance between the end walls, said arcuate surface of the support beam defining an arc having a length which is greater than half the length of the bin.

19. A bin as set forth in claim 18 wherein the arc of the arcuate surface has an apex generally equidistant between the end walls.

20. A bin as set forth in claim 18 wherein the support beam has a forward end portion generally under the forward end wall and a rearward end portion generally under the rearward end wall, said end portions having downwardly facing surface portions lying in a plane $P_2$ spaced below lower edges of the stiffening ribs.

* * * * *